US011555233B2

(12) United States Patent
Ota et al.

(10) Patent No.: US 11,555,233 B2
(45) **Date of Patent: *Jan. 17, 2023**

(54) THICK STEEL PLATE FOR STRUCTURAL PIPES OR TUBES, METHOD OF PRODUCING THICK STEEL PLATE FOR STRUCTURAL PIPES OR TUBES, AND STRUCTURAL PIPES AND TUBES

(71) Applicant: JFE STEEL CORPORATION, Tokyo (JP)

(72) Inventors: Shusaku Ota, Tokyo (JP); Junji Shimamura, Tokyo (JP); Nobuyuki Ishikawa, Tokyo (JP); Shigeru Endo, Tokyo (JP)

(73) Assignee: JFE STEEL CORPORATION, Tokyo (JP)

( * ) Notice: Subject to any disclaimer, the term of this patent is extended or adjusted under 35 U.S.C. 154(b) by 789 days.

This patent is subject to a terminal disclaimer.

(21) Appl. No.: 15/560,677

(22) PCT Filed: Mar. 25, 2016

(86) PCT No.: PCT/JP2016/001763

§ 371 (c)(1),
(2) Date: Sep. 22, 2017

(87) PCT Pub. No.: WO2016/152170

PCT Pub. Date: Sep. 29, 2016

(65) Prior Publication Data

US 2018/0105907 A1 Apr. 19, 2018
US 2018/0320257 A9 Nov. 8, 2018

(30) Foreign Application Priority Data

Mar. 26, 2015 (WO) ..... PCT/JP2015/001750

(51) Int. Cl.

| | |
|---|---|
| ***C22C 38/58*** | (2006.01) |
| ***C21D 8/02*** | (2006.01) |
| ***C22C 38/00*** | (2006.01) |
| ***C22C 38/02*** | (2006.01) |
| ***C22C 38/06*** | (2006.01) |
| ***C22C 38/42*** | (2006.01) |
| ***C22C 38/44*** | (2006.01) |
| ***C22C 38/46*** | (2006.01) |
| ***C22C 38/48*** | (2006.01) |
| ***C22C 38/50*** | (2006.01) |
| ***C22C 38/14*** | (2006.01) |
| ***C22C 38/26*** | (2006.01) |
| ***C22C 38/38*** | (2006.01) |
| ***C22C 38/04*** | (2006.01) |
| ***C22C 38/24*** | (2006.01) |
| ***C22C 38/22*** | (2006.01) |
| ***C22C 38/28*** | (2006.01) |
| ***C22C 38/12*** | (2006.01) |
| *C21D 9/46* | (2006.01) |

(Continued)

(52) U.S. Cl.

CPC ..... *C22C 38/58* (2013.01); *C21D 8/02* (2013.01); *C21D 8/0205* (2013.01); *C21D 8/0226* (2013.01); *C21D 8/0263* (2013.01); *C22C 38/00* (2013.01); *C22C 38/001* (2013.01); *C22C 38/002* (2013.01); *C22C 38/02* (2013.01); *C22C 38/04* (2013.01); *C22C 38/06* (2013.01); *C22C 38/12* (2013.01); *C22C 38/14* (2013.01); *C22C 38/22* (2013.01); *C22C 38/24* (2013.01); *C22C 38/26* (2013.01); *C22C 38/28* (2013.01); *C22C 38/38* (2013.01); *C22C 38/42* (2013.01); *C22C 38/44* (2013.01); *C22C 38/46* (2013.01); *C22C 38/48* (2013.01); *C22C 38/50* (2013.01); *C21D 1/19* (2013.01); *C21D 1/20* (2013.01); *C21D 9/46* (2013.01); *C21D 2211/002* (2013.01); *C21D 2211/005* (2013.01)

(58) Field of Classification Search

CPC ..... C21D 2211/002; C21D 8/0226; C21D 8/0263; C21D 9/46; C22C 38/00
USPC ..... 148/337
See application file for complete search history.

(56) References Cited

U.S. PATENT DOCUMENTS 5,798,004 A 8/1998 Tamehiro et al.
6,245,290 B1 6/2001 Koo et al.
(Continued)

FOREIGN PATENT DOCUMENTS

CN 101151393 A 3/2008
CN 101163807 A 4/2008
(Continued)

OTHER PUBLICATIONS

May 8, 2019, Office Action issued by the China National Intellectual Property Administration in the corresponding Chinese Patent Application No. 201680017772.3 with English language search report.
(Continued)

*Primary Examiner* — Jie Yang
(74) *Attorney, Agent, or Firm* — Kenja IP Law PC

(57) ABSTRACT

Disclosed is, as a high-strength steel plate of API X80 grade or higher with a thickness of 38 mm or more, a thick steel plate for structural pipes or tubes that exhibits high strength in the rolling direction and excellent Charpy properties at its mid-thickness part without addition of large amounts of alloying elements. The thick steel plate for structural pipes or tubes disclosed herein has: a specific chemical composition; a microstructure at its mid-thickness part that is a dual-phase microstructure of ferrite and bainite with an area fraction of the ferrite being less than 50%, and that contains ferrite grains with a grain size of 15 μm or less in an area fraction of 80% or more with respect to the whole area of the ferrite; a tensile strength of 620 MPa or more; and a Charpy absorption energy $vE_{-20+C.}$ at −20° C. at the mid-thickness part of 100 J or more.

21 Claims, No Drawings

(51) Int. Cl.
*C21D 1/19* (2006.01)
*C21D 1/20* (2006.01)

(56) References Cited

U.S. PATENT DOCUMENTS

| | | | | |
|---|---|---|---|---|
| 8,177,925 | B2 * | 5/2012 | Takahashi | C22C 38/14 148/336 |
| 8,758,528 | B2 | 6/2014 | Shimamura et al. | |
| 9,089,919 | B2 | 7/2015 | Nishimura et al. | |
| 10,358,708 | B2 | 7/2019 | Shimamura et al. | |
| 2007/0193666 | A1 | 8/2007 | Asahi et al. | |
| 2009/0120541 | A1 | 5/2009 | Shimamura et al. | |
| 2009/0297872 | A1 | 12/2009 | Takahashi et al. | |
| 2018/0051363 | A1 * | 2/2018 | Shimamura | B23K 31/027 |

FOREIGN PATENT DOCUMENTS

| | | | |
|---|---|---|---|
| CN | 101331019 | A | 12/2008 |
| EP | 1354973 | A1 | 10/2003 |
| EP | 1870484 | A1 | 12/2007 |
| JP | H1150188 | A | 2/1999 |
| JP | 2001158939 | A | 6/2001 |
| JP | 2004131799 | A | 4/2004 |
| JP | 2006257499 | A | 9/2006 |
| JP | 2006283147 | A | 10/2006 |
| JP | 2008248315 | A | 10/2008 |
| JP | 2009057629 | A | 3/2009 |
| JP | 2009512787 | A | 3/2009 |
| JP | 2014043627 | A | 3/2014 |
| KR | 1020070094846 | A | 9/2007 |
| KR | 1020120083935 | A | 7/2012 |
| RU | 2136775 | C1 | 9/1999 |
| RU | 2205245 | C2 | 5/2003 |

OTHER PUBLICATIONS

Jun. 4, 2018, Office Action issued by the State Intellectual Property Office in the corresponding Chinese Patent Application No. 201680017772.3, with English language Search Report.

Aug. 29, 2018, Communication pursuant to Article 94(3) EPC issued by the European Patent Office in the corresponding European Patent Application No. 16768073.5.

Aug. 30, 2018, Office Action issued by the Federal Service for Intellectual Property, Patents and Trademarks of the Russian Federation in the corresponding Russian Patent Application No. 2017135290 with English language Search Report.

Oct. 18, 2018, Office Action issued by the Canadian Intellectual Property Office in the corresponding Canadian Patent Application No. 2,980,247.

Dec. 18, 2018, Office Action issued by the Korean Intellectual Property Office in the corresponding Korean Patent Application No. 10-2017-7029967 with English language Concise Statement of Relevance.

Mar. 4, 2019, Communication pursuant to Article 94(3) EPC issued by the European Patent Office in the corresponding European Patent Application No. 16768073.5.

Jun. 14, 2016, International Search Report issued in the International Patent Application No. PCT/JP2016/001763.

Sep. 12, 2017, Notification of Reasons for Refusal issued by the Japan Patent Office in the corresponding Japanese Patent Application No. 2017-507510 with English language concise statement of relevance.

Jan. 3, 2018, Extended European Search Report issued by the European Patent Office in the corresponding European Patent Application No. 16768073.5.

Sep. 9, 2019, Office Action issued by the Korean Intellectual Property Office in the corresponding Korean Patent Application No. 10-2017-7029967 with English language concise statement of relevance.

Dec. 3, 2019, Office Action issued by the United States Patent and Trademark Office in the U.S. Appl. No. 15/560,613.

Feb. 13, 2020, Office Action issued by the Canadian Intellectual Property Office in the corresponding Canadian Patent Application No. 2,980,247.

* cited by examiner

THICK STEEL PLATE FOR STRUCTURAL PIPES OR TUBES, METHOD OF PRODUCING THICK STEEL PLATE FOR STRUCTURAL PIPES OR TUBES, AND STRUCTURAL PIPES AND TUBES

TECHNICAL FIELD

This disclosure relates to a thick steel plate for structural pipes or tubes, and in particular, to a thick steel plate for structural pipes or tubes that has strength of API X80 grade or higher and that exhibits excellent Charpy properties at its mid-thickness part even with a plate thickness of 38 mm or more.

This disclosure also relates to a method of producing a thick steel plate for structural pipes or tubes, and to a structural pipe or tube produced from the thick steel plate for structural pipes or tubes.

BACKGROUND

For excavation of oil and gas by seabed resource drilling ships and the like, structural pipes or tubes such as conductor casing steel pipes or tubes, riser steel pipes or tubes, and the like are used. In these applications, there has been an increasing demand for high-strength thick steel pipes or tubes of no lower than American Petroleum Institute (API) X80 grade from the perspectives of improving operation efficiency with increased pressure and reducing material costs.

Such structural pipes or tubes are often used with forged products containing alloying elements in very large amounts (such as connectors) subjected to girth welding. For a forged product subjected to welding, post weld heat treatment (PWHT) is performed to remove the residual stress caused by the welding from the forged product. In this case, there may be a concern about deterioration of mechanical properties such as strength after heat treatment. Accordingly, structural pipes or tubes are required to retain excellent mechanical properties, in particular high strength, in their longitudinal direction, that is, rolling direction, even after subjection to PWHT in order to prevent fractures during excavation by external pressure on the seabed.

Thus, for example, JPH1150188A (PTL 1) proposes a process for producing a high-strength steel plate for riser steel pipes or tubes that can exhibit excellent strength even after subjection to stress relief (SR) annealing, which is one type of PWHT, at a high temperature of 600° C. or higher, by hot rolling a steel to which 0.30% to 1.00% of Cr, 0.005% to 0.0030% of Ti, and 0.060% or less of Nb are added, and then subjecting it to accelerated cooling.

In addition, JP2001158939A (PTL 2) proposes a welded steel pipe or tube that has a base steel portion and weld metal with chemical compositions in specific ranges and both having a yield strength of 551 MPa or more. PTL 2 describes that the welded steel pipe or tube has excellent toughness before and after SR in the weld zone.

CITATION LIST

Patent Literature

PTL 1:JPH1150188A

PTL 2: JP2001158939A

SUMMARY

Technical Problem

In the steel plate described in PTL 1, however, Cr carbide is caused to precipitate during PWHT in order to compensate for the decrease in strength due to PWHT, which requires adding a large amount of Cr. Accordingly, in addition to high material cost, weldability and toughness may deteriorate.

In addition, the steel pipes or tubes described in PTL 2 focus on improving the characteristics of seam weld metal, without giving consideration to the base steel, and inevitably involve decrease in the strength of the base steel by PWHT. To secure the strength of the base steel, it is necessary to increase the strength before performing PWHT by controlled rolling or accelerated cooling.

It could thus be helpful to provide, as a high-strength steel plate of API X80 grade or higher with a thickness of 38 mm or more, a thick steel plate for structural pipes or tubes that exhibits high strength in a direction perpendicular to the rolling direction and excellent Charpy properties at its mid-thickness part without addition of large amounts of alloying elements. It could also be helpful to provide a method of producing the above-described thick steel plate for structural pipes or tubes, and a structural pipe or tube produced from the thick steel plate for structural pipes or tubes.

Solution to Problem

For thick steel plates having a thickness of 38 mm or more, we conducted detailed studies on the influence of rolling conditions on their microstructures in order to determine how to balance Charpy properties at the mid-thickness part and strength. In general, the steel components for welded steel pipes or tubes and steel plates for welded structures are strictly limited from the viewpoint of weldability. Thus, high-strength steel plates of X65 grade or higher are manufactured by being subjected to hot rolling and subsequent accelerated cooling. Thus, the steel plate has a microstructure that is mainly composed of bainite or a microstructure in which martensite austenite constituent (abbreviated MA) is formed in bainite, yet, as the plate thickness increases, deterioration of Charpy properties at the mid-thickness part would be inevitable. In view of the above, we conducted intensive studies on a microstructure capable of exhibiting excellent Charpy properties at the mid-thickness part, and as a result, arrived at the following findings:

(a) Refinement of the steel microstructure is effective for improving the Charpy properties at the mid-thickness part. It is thus necessary to increase the cumulative rolling reduction ratio in the non-recrystallization region.

(b) On the other hand, if the cooling start temperature is excessively low, the ferrite area fraction increases to 50% or more and the strength decreases. It is thus necessary to set a high cooling start temperature.

Based on the above findings, we made intensive studies on the chemical compositions and microstructures of steel as well as on the production conditions, and completed the present disclosure.

Specifically, the primary features of the present disclosure are as described below.

1. A thick steel plate for structural pipes or tubes, comprising: a chemical composition that contains (consists of), in mass%, C: 0.030% to 0.100%, Si: 0.01% to 0.50%, Mn: 1.50% to 2.50%, Al: 0.080% or less, Mo: 0.05% to 0.50%, Ti: 0.005% to 0.025%, Nb: 0.005% to 0.080%, N: 0.001% to 0.010%, 0: 0.0050% or less, P: 0.010% or less, S: 0.0010% or less, and the balance consisting of Fe and inevitable impurities, with the chemical composition having a carbon equivalent $C_{eq}$ as defined by the following Expression (1) of 0.42 or more:

$$C_{eq}=C+Mn/6+(Cu+Ni)/15+(Cr+Mo+V)/5 \quad (1),$$

where each element symbol indicates content in mass % of the element in the steel plate and has a value of 0 if the element is not contained in the steel plate; and a microstructure at a mid-thickness part of the thick steel plate that is mainly a dual-phase microstructure of ferrite and bainite composed of bainite with an area fraction of the ferrite being less than 50%, and that contains ferrite grains with a grain size of 15 μm or less in an area fraction of 80% or more with respect to the whole area of the ferrite, with the steel plate satisfying a set of conditions including: a tensile strength being 620 MPa or more; and a Charpy absorption energy $vE_{-20°C}$ at −20° C. at the mid-thickness part being 100 J or more.

2. The thick steel plate for structural pipes or tubes according to 1., wherein the chemical composition further contains, in mass %, V: 0.005% to 0.100%.

3. The thick steel plate for structural pipes or tubes according to 1. or 2., wherein the chemical composition further contains, in mass %, one or more selected from the group consisting of Cu: 0.50% or less, Ni: 0.50% or less, Cr: 0.50% or less, Ca: 0.0005% to 0.0035%, REM: 0.0005% to 0.0100%, and B: 0.0020% or less.

4. A method of producing a thick steel plate for structural pipes or tubes, comprising at least: heating a steel raw material having the chemical composition as recited in any one of 1. to 3. to a heating temperature of 1100° C. to 1300° C.; hot-rolling the heated steel raw material, with a cumulative rolling reduction ratio at 800° C. or lower being set to 70% or more, to obtain a hot-rolled steel plate; accelerated-cooling the hot-rolled steel plate under a set of conditions including a cooling start temperature being no lower than 650° C., a cooling end temperature being lower than 400° C., and an average cooling rate being 5° C./s or higher.

5. The method producing a thick steel plate for structural pipes or tubes according to 4., further comprising, immediately after the accelerated cooling, reheating the steel plate to a temperature range of 400° C. to 550° C. at a heating rate from 0.5° C./s to 10° C./s.

6. A structural pipe or tube formed from the thick steel plate for structural pipes or tubes as recited in any one of 1. to 3.

7. A structural pipe or tube obtainable by forming the steel plate for structural pipes or tubes as recited in any one of 1. to 3. into a tubular shape in its longitudinal direction, and then joining butting faces by welding from inside and outside to form at least one layer on each side along the longitudinal direction.

Advantageous Effect

According to the present disclosure, it is possible to provide, as a high-strength steel plate of API X80 grade or higher, a thick steel plate for structural pipes or tubes that exhibits high strength in the rolling direction and excellent Charpy properties at its mid-thickness part without addition of large amounts of alloying elements, and a structural pipe or tube formed from the steel plate for structural pipes or tubes. As used herein, the term "thick" means that the plate thickness is 38 mm or more.

DETAILED DESCRIPTION

Chemical Composition

Reasons for limitations on the features of the disclosure will be explained below.

In the present disclosure, it is important that a thick steel plate for structural pipes or tubes has a specific chemical composition. The reasons for limiting the chemical composition of the steel as stated above are explained first. The % representations below indicating the chemical composition are in mass % unless otherwise noted.

C: 0.030% to 0.100%

C is an element for increasing the strength of steel. To obtain a desired microstructure for desired strength and toughness, the C content needs to be 0.030% or more. However, if the C content exceeds 0.100%, weldability deteriorates, weld cracking tends to occur, and the toughness of base steel and HAZ toughness are lowered. Therefore, the C content is set to 0.100% or less. The C content is preferably 0.050% to 0.080%.

Si: 0.01% to 0.50%

Si is an element that acts as a deoxidizing agent and increases the strength of the steel material by solid solution strengthening. To obtain this effect, the Si content is set to 0.01% or more. However, Si content of greater than 0.50% causes noticeable deterioration in HAZ toughness. Therefore, the Si content is set to 0.50% or less. The Si content is preferably 0.05% to 0.20%.

Mn: 1.50% to 2.50%

Mn is an effective element for increasing the hardenability of steel and improving strength and toughness. To obtain this effect, the Mn content is set to 1.50% or more. However, Mn content of greater than 2.50% causes deterioration of weldability. Therefore, the Mn content is set to 2.50% or less. The Mn content is preferably from 1.80% to 2.00%.

Al: 0.080% or less

Al is an element that is added as a deoxidizer for steelmaking. However, Al content of greater than 0.080% leads to reduced toughness. Therefore, the Al content is set to 0.080% or less. The Al content is preferably from 0.010% to 0.050%.

Mo: 0.05% to 0.50%

Mo is a particularly important element for the present disclosure that functions to greatly increase the strength of the steel plate by forming fine complex carbides with Ti, Nb, and V, while suppressing pearlite transformation during cooling after hot rolling. To obtain this effect, the Mo content is set to 0.05% or more. However, Mo content of greater than 0.50% leads to reduced toughness at the heat-affected zone (HAZ). Therefore, the Mo content is set to 0.50% or less.

Ti: 0.005% to 0.025%

In the same way as Mo, Ti is a particularly important element for the present disclosure that forms complex precipitates with Mo and greatly contributes to improvement in the strength of steel. To obtain this effect, the Ti content is set to 0.005% or more. However, adding Ti beyond 0.025% leads to deterioration in HAZ toughness and toughness of base steel. Therefore, the Ti content is set to 0.025% or less.

Nb: 0.005% to 0.080%

Nb is an effective element for improving toughness by refining microstructural grains. In addition, Nb forms composite precipitates with Mo and contributes to improvement in strength. To obtain this effect, the Nb content is set to 0.005% or more. However, Nb content of greater than 0.080% causes deterioration of HAZ toughness. Therefore, the Nb content is set to 0.080% or less.

N: 0.001% to 0.010%

N is normally present in the steel as an inevitable impurity and, in the presence of Ti, forms TiN. To suppress coarsening of austenite grains caused by the pinning effect of TiN, the N content is set to 0.001% or more. However, TiN decomposes in the weld zone, particularly in the region heated to 1450° C. or higher near the weld bond, and produces solute N. Accordingly, if the N content is excessively increased, a decrease in toughness due to the formation of the solute N becomes noticeable. Therefore, the N content is set to 0.010% or less. The N content is more preferably 0.002% to 0.005%.

O: 0.0050% or less, P: 0.010% or less, S: 0.0010% or less

In the present disclosure, O, P, and S are inevitable impurities, and the upper limit for the contents of these elements is defined as follows. O forms coarse oxygen inclusions that adversely affect toughness. To suppress the influence of the inclusions, the O content is set to 0.0050% or less. In addition, P lowers the toughness of the base metal upon central segregation, and a high P content causes the problem of reduced toughness of base metal. Therefore, the P content is set to 0.010% or less. In addition, S forms MnS inclusions and lowers the toughness of base metal, and a high S content causes the problem of reduced toughness of the base material. Therefore, the S content is set to 0.0010% or less. It is noted here that the O content is preferably 0.0030% or less, the P content is preferably 0.008% or less, and the S content is preferably 0.0008% or less. No lower limit is placed on the contents of O, P, and S, yet in industrial terms the lower limit is more than 0%. On the other hand, excessively reducing the contents of these elements leads to longer refining time and increased cost. Therefore, the O content is 0.0005% or more, the P content is 0.001% or more, and the S content is 0.0001% or more.

In addition to the above elements, the thick steel plate for structural pipes or tubes disclosed herein may further contain V: 0.005% to 0.100%.

V: 0.005% to 0.100%

In the same way as Nb, V forms composite precipitates with Mo and contributes to improvement in strength. When V is added, the V content is set to 0.005% or more to obtain this effect. However, V content of greater than 0.100% causes deterioration of HAZ toughness. Therefore, when V is added, the V content is set to 0.100% or less.

In addition to the above elements, the thick steel plate for structural pipes or tubes may further contain Cu: 0.50% or less, Ni: 0.50% or less, Cr: 0.50% or less, Ca: 0.0005% to 0.0035%, REM: 0.0005 to 0.0100%, and B: 0.0020% or less.

Cu: 0.50% or less

Cu is an effective element for improving toughness and strength, yet excessively adding Cu causes deterioration of weldability. Therefore, when Cu is added, the Cu content is set to 0.50% or less. No lower limit is placed on the Cu content, yet when Cu is added, the Cu content is preferably 0.05% or more.

Ni: 0.50% or less

Ni is an effective element for improving toughness and strength, yet excessively adding Ni causes deterioration of resistance to PWHT. Therefore, when Ni is added, the Ni content is set to 0.50% or less. No lower limit is placed on the Ni content, yet when Ni is added, the Ni content is preferably to 0.05% or more.

Cr: 0.50% or less

In the same way as Mn, Cr is an effective element for obtaining sufficient strength even with a low C content, yet excessive addition lowers weldability. Therefore, when Cr is added, the Cr content is set to 0.50% or less. No lower limit is placed on the Cr content, yet when Cr is added, the Cr content is preferably set to 0.05% or more.

Ca: 0.0005% to 0.0035%

Ca is an effective element for improving toughness by morphological control of sulfide inclusions. To obtain this effect, when Ca is added, the Ca content is set to 0.0005% or more. However, adding Ca beyond 0.0035% does not increase the effect, but rather leads to a decrease in the cleanliness of the steel, causing deterioration of toughness. Therefore, when Ca is added, the Ca content is set to 0.0035% or less.

REM: 0.0005% to 0.0100%

In the same way as Ca, a REM (rare earth metal) is an effective element for improving toughness by morphological control of sulfide inclusions in the steel. To obtain this effect, when a REM is added, the REM content is set to 0.0005% or more. However, excessively adding a REM beyond 0.0100% does not increase the effect, but rather leads to a decrease in the cleanliness of the steel, causing deterioration of toughness. Therefore, the REM is set to 0.0100% or less.

B: 0.0020% or less

B segregates at austenite grain boundaries and suppresses ferrite transformation, thereby contributing particularly to preventing reduction in HAZ strength. However, adding B beyond 0.0020% does not increase the effect. Therefore, when B is added, the B content is set to 0.0020% or less. No lower limit is placed on the B content, yet when B is added, the B content is preferably 0.0002% or more.

The thick steel plate for structural pipes or tubes disclosed herein consists of the above-described components and the balance of Fe and inevitable impurities. As used herein, the phrase "consists of . . . the balance of Fe and inevitable impurities" is intended to encompass a chemical composition that contains inevitable impurities and other trace elements as long as the action and effect of the present disclosure are not impaired.

In the present disclosure, it is important that all of the elements contained in the steel satisfy the above-described conditions and that the chemical composition has a carbon equivalent $C_{eq}$ of 0.42 or more, where $C_{eq}$ is defined by:

$$C_{eq}=C+Mn/6+(Cu+Ni)/15+(Cr+Mo+V)/5 \quad (1),$$

where each element symbol indicates content in mass % of the element in the steel plate and has a value of 0 if the element is not contained in the steel plate.

$C_{eq}$ is expressed in terms of carbon content representing the influence of the elements added to the steel, which is commonly used as an index of strength as it correlates with the strength of base metal. In the present disclosure, to obtain a high strength of API X80 grade or higher, $C_{eq}$ is set to 0.42 or more. $C_{eq}$ is preferably 0.43 or more. No upper limit is placed on $C_{eq}$, yet a preferred upper limit is 0.50.

Microstructure at Mid-Thickness Part

Next, the reasons for limitations on the steel microstructure according to the disclosure are described.

In the present disclosure, it is important for the steel plate to have a microstructure at its mid-thickness part that is a dual-phase microstructure of ferrite and bainite with an area fraction of the ferrite being less than 50%, and that contains ferrite grains with a grain size of 15 μm or less in an area fraction of 80% or more with respect to the whole area of the ferrite. Controlling the microstructure in this way makes it possible to ensure Charpy properties at the mid-thickness part while providing high strength of API X80 grade. In the case of a thick steel plate with a plate thickness of 38 mm or more according to the disclosure, if these microstructural conditions are satisfied at the mid-thickness part, it is considered that the resulting microstructure meets the microstructural conditions substantially over the entire region in the plate thickness direction, and the effects of the present disclosure may be obtained As used herein, the phrase "a dual-phase microstructure of ferrite and bainite" refers to a microstructure that consists essentially of only ferrite and bainite, yet as long as the action and effect of the present disclosure are not impaired, those containing other microstructural constituents are intended to be encompassed within the scope of the disclosure. Specifically, the total area fraction of ferrite and bainite in the microstructure of steel is preferably 90% or more, and more preferably 95% or more. Specifically, the total area fraction of ferrite and bainite in the steel microstructure is preferably 90% or more, and more preferably 95% or more. On the other hand, the total area fraction of ferrite and bainite is desirably as high as possible without any particular upper limit. The area fraction of bainite may be 100%.

The amount of microstructural constituents other than ferrite and bainite is preferably as small as possible. However, when the area fraction of ferrite and bainite is sufficiently high, the influence of the residual microstructural constituents is almost negligible, and an acceptable total area fraction of one or more of the microstructural constituents other than ferrite and bainite in the microstructure is up to 10%. A preferred total area fraction of these microstructural constituents other than ferrite is up to 5%. Examples of the residual microstructural constituents include pearlite, cementite, martensite, and martensite austenite constituent.

In addition, the area fraction of ferrite in the microstructure at the mid-thickness part needs to be less than 50%. The area fraction of ferrite is preferably 40% or less. On the other hand, no lower limit is placed on the area fraction of ferrite, yet a preferred lower limit is 5%.

Furthermore, to secure Charpy properties at the mid-thickness part of the steel plate, it is necessary for the microstructure at the mid-thickness part to contain ferrite grains with a grain size of 15 μm or less in an area fraction of 80% or more with respect to the whole area of the ferrite. The area fraction of ferrite grains with a grain size of 15 μm or less is preferably as high as possible without any particular upper limit, and may be 100%.

The area fraction of ferrite and bainite and the grain size of ferrite may be determined by mirror-polishing a test piece sampled from the mid-thickness part (location of half the plate thickness), etching its surface with nital, and observing five or more fields randomly selected on the surface under a scanning electron microscope (at 1000 times magnification), In this disclosure, equivalent circle radius is used as the grain size.

Mechanical Properties

The thick steel plate for structural pipes or tubes disclosed herein has mechanical properties including: a tensile strength of 620 MPa or more; and a Charpy absorption energy $vE_{-20° C.}$ at −20° C. at its mid-thickness part of 100 J or more. In this respect, tensile strength and Charpy absorption energy can be measured with the method described in examples explained later. No upper limit is placed on tensile strength, yet an exemplary upper limit is 825 MPa or less for X80 grade and 990 MPa or less for X100 grade. Similarly, the upper limit for $vE_{-20° C.}$ is also not particularly limited, yet it is normally 500 J or less.

Steel Plate Production Method

Next, a method of producing a steel plate according to the present disclosure is described. In the following explanation, it is assumed that the temperature is the average temperature in the thickness direction of the steel plate unless otherwise noted. The average temperature in the plate thickness direction can be determined by, for example, the plate thickness, surface temperature, or cooling conditions through simulation calculation or the like. For example, the average temperature in the plate thickness direction of the steel plate can be determined by calculating the temperature distribution in the plate thickness direction using a finite difference method.

The thick steel plate for structural pipes or tubes disclosed herein may be produced by sequentially performing operations (1) to (3) below on the steel raw material having the above chemical composition. Additionally, optional operation (4) may be performed.

(1) heating the steel raw material to a heating temperature of 1100° C. to 1300° C.;
(2) hot-rolling the heated steel material, with a cumulative rolling reduction ratio at 800° C. or lower being set to 70% or more, to obtain a hot-rolled steel plate;
(3) accelerated-cooling the hot-rolled steel plate under a set of conditions including a cooling start temperature being no lower than 650° C., a cooling end temperature being lower than 400° C., and an average cooling rate being 5° C./s or higher;
(4) immediately after the accelerated cooling, reheating the steel plate to a temperature range of 400° C. to 550° C. at a heating rate from 0.5° C./s to 10° C./s.

Specifically, the above-described operations may be performed as described below.

Steel Raw Material

The above-described steel raw material may be prepared with a regular method. The method of producing the steel raw material is not particularly limited, yet the steel raw material is preferably prepared with continuous casting.

Heating

The steel raw material is heated prior to rolling. At this time, the heating temperature is set from 1100° C. to 1300° C. Setting the heating temperature to 1100° C. or higher makes it possible to cause carbides in the steel raw material to dissolve, and to obtain the target strength. The heating temperature is preferably set to 1120° C. or higher. However, a heating temperature of higher than 1300° C. coarsens austenite grains and the final steel microstructure, causing deterioration of toughness. Therefore, the heating temperature is set to 1300° C. or lower. The heating temperature is preferably set to 1250° C. or lower.

Hot Rolling

Then, the heated steel raw material is rolled to obtain a hot-rolled steel plate. At this point, if the cumulative rolling reduction ratio at 800° C. or lower is below 70%, it is not possible to optimize the microstructure at the mid-thickness part of the steel plate after the rolling. Therefore, the cumulative rolling reduction ratio at 800° C. or lower is set to 70% or more. No upper limit is placed on the cumulative rolling reduction ratio at 800° C. or lower, yet a normal upper limit is 90%. The rolling finish temperature is not particularly limited, yet from the perspective of ensuring a cumulative rolling reduction ratio at 800° C. or lower as described above, a preferred rolling finish temperature is 780° C. or lower, and more preferably 760° C. or lower. In addition, to ensure the cooling start temperature as described above, the rolling finish temperature is preferably set to 700° C. or higher, and more preferably to 720° C. or higher.

Accelerated Cooling

After completion of the hot rolling, the hot-rolled steel plate is subjected to accelerated cooling. At that time, if the accelerated cooling start temperature is below 650° C., ferrite increases to 50% or more, causing a large decrease in strength. Therefore, the cooling start temperature is set to 650° C. or higher. The cooling start temperature is preferably 680° C. or higher from the perspective of ensuring a certain area fraction of ferrite. On the other hand, no upper limit is placed on the cooling start temperature, yet a preferred upper limit is 780° C.

On the other hand, if the cooling finish temperature is excessively high, transformation to bainite does not proceed sufficiently and a large amount of pearlite or martensite austenite constituent is generated, which may adversely affect the toughness. Therefore, the cooling finish temperature is set to lower than 400° C. No lower limit is placed on the cooling end temperature, yet a preferred lower limit is 200° C.

In addition, if the cooling rate is excessively low, transformation to bainite does not proceed sufficiently and a large amount of pearlite is generated, which may adversely affect the toughness. Therefore, the average cooling rate is set to 5° C./s or higher. No upper limit is placed on the average cooling rate, yet a preferred upper limit is 25° C./s.

Reheating

After completion of the accelerated cooling, reheating may be performed. Even if the accelerated cooling stop temperature is low and a large amount of low-temperature transformed microstructure other than bainite, such as martensite, is produced, performing reheating and tempering makes it possible to ensure specific toughness. In the case the reheating is performed, the reheating is carried out, immediately after the accelerated cooling, to a temperature range of 400° C. to 550° C. at a heating rate from 0.5° C./s to 10° C./s. As used herein, the phrase "immediately after the accelerated cooling" refers to starting reheating at a heating rate from 0.5° C./s to 10° C./s within 120 seconds after the completion of the accelerated cooling.

Through the above process, it is possible to produce a thick steel plate for structural pipes or tubes that has strength of API X80 grade or higher and that is excellent in Charpy properties at its mid-thickness part. As described above, the thick steel plate for structural pipes or tubes disclosed herein is intended to have a plate thickness of 38 mm or more. Although no upper limit is placed on the plate thickness, a preferred plate thickness is 60 mm or less because it may be difficult to satisfy the production conditions described herein if the plate thickness is greater than 60 mm.

Steel Pipe or Tube

A steel pipe or tube can be produced by using the steel plate thus obtained as a material. The steel pipe or tube may be, for example, a structural pipe or tube that is obtainable by forming the thick steel plate for structural pipes or tubes into a tubular shape in its longitudinal direction, and then joining butting faces by welding. The method of producing a steel pipe or tube is not limited to a particular method, and any method is applicable. For example, a UOE steel pipe or tube may be obtained by forming a steel plate into a tubular shape in its longitudinal direction by U press and O press following a conventional method, and then joining butting faces by seam welding. Preferably, the seam welding is performed by performing tack welding and subsequently submerged arc welding from inside and outside to form one layer on each side. The flux used for submerged arc welding is not limited to a particular type, and may be a fused flux or a bonded flux. After the seam welding, expansion is carried out to remove welding residual stress and to improve the roundness of the steel pipe or tube. In the expansion, the expansion ratio (the ratio of the amount of change in the outer diameter before and after expansion of the pipe or tube to the outer diameter of the pipe or tube before expansion) is normally set from 0.3% to 1.5%. From the viewpoint of the balance between the roundness improving effect and the capacity required for the expanding device, the expansion rate is preferably from 0.5% to 1.2%. Instead of the above-mentioned UOE process, a press bend method, which is a sequential forming process to perform three-point bending repeatedly on a steel plate, may be applied to form a steel pipe or tube having a substantially circular cross-sectional shape before performing seam welding in the same manner as in the above-described UOE process. In the case of the press bend method, as in the UOE process, expansion may be performed after seam welding. In the expansion, the expansion ratio (the ratio of the amount of change in the outer diameter before and after expansion of the pipe or tube to the outer diameter of the pipe or tube before expansion) is normally set from 0.3% to 1.5%. From the viewpoint of the balance between the roundness increasing effect and the capacity required for the expanding device, the expansion rate is preferably from 0.5% to 1.2%. Optionally, preheating before welding or heat treatment after welding may be performed.

EXAMPLES

Steels having the chemical compositions presented in Table 1 (each with the balance consisting of Fe and inevitable impurities) were prepared by steelmaking and formed into slabs by continuous casting. The obtained slabs were used as raw material to produce steel plates with a thickness of 38 mm to 51 mm. For each obtained steel plate, the area fraction of ferrite and bainite in the microstructure and the mechanical properties were evaluated as described below. The evaluation results are presented in Table 3.

The area fraction of ferrite and bainite was evaluated by mirror-polishing a test piece sampled from the mid-thickness part, etching its surface with nital, and observing five or more fields randomly selected on the surface under a scanning electron microscope (at 1000 times magnification).

Among the mechanical properties, 0.5% yield strength (YS) and tensile strength (TS) were measured by preparing full-thickness test pieces sampled from each obtained thick steel plate in a direction perpendicular to the rolling direction, and then conducting a tensile test on each test piece in accordance with JIS Z 2241 (1998).

As for Charpy properties, among the mechanical properties, three 2 mm V notch Charpy test pieces were sampled from the mid-thickness part with their longitudinal direction parallel to the rolling direction, and the test pieces were subjected to a Charpy impact test at −20° C. energy ($vE_{-20°\ C.}$), to obtain absorption energy $vE_{-20°\ C.}$, and the average values were calculated.

For evaluation of heat affected zone (HAZ) toughness, a test piece to which heat hysteresis corresponding to heat input of 40 kJ/cm to 100 kJ/cm was applied by a reproducing apparatus of weld thermal cycles was prepared and subjected to a Charpy impact test. Measurements were made in the same manner as in the evaluation of Charpy absorption energy at −20° C. described above, and the case of Charpy absorption energy at −20° C. being 100 J or more was evaluated as "Good", and less than 100 J as "Poor".

Further, for evaluation of PWHT resistance, PWHT treatment was performed on each steel plate using a gas atmosphere furnace. At this time, heat treatment was performed on each steel plate at 600° C. for 2 hours, after which the steel plate was removed from the furnace and cooled to room temperature by air cooling. Each steel plate subjected to PWHT treatment was measured for 0.5% YS, TS, and $vE_{-20°\ C.}$ in the same manner as in the above-described measurements before PWHT.

As can be seen from Table 3, examples (Nos. 1 to 7) which satisfy the conditions disclosed herein exhibited excellent mechanical properties before and after subjection to PWHT. In contrast, comparative examples (Nos. 8 to 18) which do not satisfy the conditions disclosed herein were inferior in mechanical properties before and/or after subjection to PWTH. For example, Nos. 8 to 12 were inferior in strength of base metal, and Charpy properties, although their steel compositional ranges met the conditions of the present disclosure. Of these, for No. 9, Charpy properties are considered to be deteriorated due to a low cumulative rolling reduction ratio at 800° C. or lower and accordingly to a lower area fraction of ferrite grains with a grain size of 15 μm or less. For No. 10, the microstructure of the steel plate contained ferrite in an area fraction of greater than 50%, which is considered as a cause of lower strength of base metal. Nos. 13 to 18 were inferior in at least one of the strength of base metal, Charpy properties, and HAZ toughness because their steel compositional ranges were outside the range of the present disclosure.

TABLE 1

| Steel | Chemical composition (mass %)* | | | | | | | | | | | |
|---|---|---|---|---|---|---|---|---|---|---|---|---|
| ID | C | Si | Mn | P | S | Mo | Ti | Nb | V | Al | Cu | Ni |
| A | 0.072 | 0.24 | 1.78 | 0.008 | 0.0008 | 0.28 | 0.011 | 0.024 | 0.023 | 0.032 | — | — |
| B | 0.065 | 0.16 | 1.82 | 0.008 | 0.0008 | 0.14 | 0.018 | 0.044 | 0.066 | 0.035 | 0.10 | 0.20 |
| C | 0.060 | 0.20 | 1.79 | 0.008 | 0.0008 | 0.20 | 0.017 | 0.036 | 0.045 | 0.038 | 0.21 | 0.23 |
| D | 0.061 | 0.19 | 1.85 | 0.008 | 0.0008 | 0.19 | 0.008 | 0.043 | 0.036 | 0.034 | — | — |
| E | 0.062 | 0.10 | 1.78 | 0.008 | 0.0008 | 0.14 | 0.011 | 0.044 | — | 0.035 | 0.31 | 0.14 |
| F | 0.065 | 0.10 | 1.87 | 0.008 | 0.0008 | 0.12 | 0.014 | 0.012 | — | 0.037 | 0.20 | 0.09 |
| G | 0.068 | 0.22 | 1.67 | 0.008 | 0.0008 | 0.15 | 0.020 | 0.036 | 0.052 | 0.041 | 0.15 | 0.21 |
| H | 0.024 | 0.35 | 1.85 | 0.008 | 0.0008 | 0.26 | 0.012 | 0.042 | 0.038 | 0.030 | 0.40 | 0.40 |
| I | 0.065 | 0.32 | 2.22 | 0.008 | 0.0008 | 0.02 | 0.015 | 0.035 | 0.063 | 0.032 | 0.15 | 0.40 |
| J | 0.106 | 0.25 | 1.86 | 0.008 | 0.0008 | 0.11 | 0.012 | 0.031 | — | 0.028 | — | — |
| K | 0.065 | 0.19 | 1.71 | 0.008 | 0.0008 | 0.19 | 0.043 | 0.038 | 0.047 | 0.041 | 0.30 | 0.22 |
| L | 0.058 | 0.14 | 1.84 | 0.008 | 0.0008 | 0.15 | 0.011 | 0.020 | — | 0.033 | 0.10 | 0.15 |

| Steel | Chemical composition (mass %)* | | | | | | Ceq | |
|---|---|---|---|---|---|---|---|---|
| ID | Cr | Ca | REM | B | O | N | (mass %) | Remarks |
| A | — | — | — | — | 0.002 | 0.004 | 0.43 | Conforming |
| B | 0.03 | — | 0.0012 | — | 0.002 | 0.005 | 0.44 | steel |
| C | — | — | — | 0.0005 | 0.002 | 0.005 | 0.44 | |
| D | 0.12 | — | — | — | 0.002 | 0.004 | 0.44 | |
| E | | 0.0015 | — | — | 0.002 | 0.004 | 0.42 | |
| F | 0.02 | — | — | — | 0.002 | 0.005 | 0.42 | |
| G | 0.10 | 0.0023 | — | — | 0.002 | 0.004 | 0.43 | |
| H | — | — | — | — | 0.002 | 0.004 | 0.45 | Comparative |
| I | — | — | — | — | 0.002 | 0.005 | 0.49 | steel |
| J | — | — | — | — | 0.002 | 0.004 | 0.44 | |
| K | — | — | — | — | 0.002 | 0.005 | 0.43 | |
| L | — | — | — | — | 0.002 | 0.004 | 0.41 | |

*The balance consists of Fe and inevitable impurities.

TABLE 2

| | | Hot rolling | | | Accelerated cooling | | |
|---|---|---|---|---|---|---|---|
| No. | Steel ID | Heating temp. (° C.) | Cumulative rolling reduction ratio at or below 800° C. (%) | Rolling finish temp. (° C.) | Cooling start temp. (° C.) | Cooling rate (° C./s) | Cooling end temp. (° C.) |
| 1 | A | 1250 | 75 | 760 | 720 | 20 | 290 |
| 2 | B | 1180 | 75 | 750 | 710 | 15 | 260 |

TABLE 2-continued

| | | | | | | | |
|---|---|---|---|---|---|---|---|
| 3 | C | 1180 | 70 | 770 | 710 | 14 | 280 |
| 4 | D | 1180 | 75 | 780 | 730 | 12 | 250 |
| 5 | E | 1150 | 80 | 760 | 740 | 15 | 230 |
| 6 | F | 1180 | 80 | 750 | 720 | 14 | 210 |
| 7 | G | 1190 | 75 | 770 | 750 | 15 | 270 |
| 8 | C | 1050 | 75 | 780 | 750 | 15 | 240 |
| 9 | C | 1150 | 65 | 770 | 720 | 16 | 280 |
| 10 | C | 1180 | 75 | 750 | 640 | 12 | 260 |
| 11 | C | 1180 | 75 | 780 | 760 | 4 | 280 |
| 12 | C | 1200 | 80 | 760 | 730 | 12 | 500 |
| 13 | H | 1150 | 75 | 760 | 710 | 15 | 210 |
| 14 | I | 1200 | 75 | 750 | 740 | 12 | 250 |
| 15 | J | 1180 | 75 | 760 | 730 | 14 | 280 |
| 16 | K | 1150 | 75 | 780 | 740 | 14 | 220 |
| 17 | L | 1150 | 75 | 760 | 720 | 15 | 250 |

| | Reheating | | | | |
|---|---|---|---|---|---|
| No. | Reheating apparatus | Heating rate (° C./s) | Reheating temp. (° C.) | Plate thickness (mm) | Remarks |
| 1 | — | | | 51 | Example |
| 2 | — | | | 51 | |
| 3 | — | | | 38 | |
| 4 | — | | | 51 | |
| 5 | gas-fired furnace | 1 | 480 | 51 | |
| 6 | induction heating furnace | 3 | 420 | 51 | |
| 7 | — | | | 51 | |
| 8 | — | | | 51 | Comparative |
| 9 | — | | | 51 | Example |
| 10 | — | | | 51 | |
| 11 | — | | | 51 | |
| 12 | — | | | 51 | |
| 13 | induction heating furnace | 9 | 400 | 51 | |
| 14 | — | | | 51 | |
| 15 | — | | | 51 | |
| 16 | — | | | 51 | |
| 17 | — | | | 51 | |

TABLE 3

| | | Microstructure at mid-thickness part | | | | Mechanical properties (before PWHT) | | | | Mechanical properties (after PWHT) | | | |
|---|---|---|---|---|---|---|---|---|---|---|---|---|---|
| No. | Steel ID | Area fraction of F* (%) | Area fraction of F + B* (%) | Residual microstructural constituents* | Area fraction of F with grain size of 15 μm or less (%) | 0.5% YS (MPa) | TS (MPa) | $vE_{-20° C.}$ (J) | HAZ toughness | 0.5% YS (MPa) | TS (MPa) | $vE_{-20° C.}$ (J) | Remarks |
| 1 | A | 18 | 100 | — | 90 | 610 | 675 | 186 | Good | 604 | 671 | 174 | Example |
| 2 | B | 12 | 96 | MA | 85 | 627 | 705 | 157 | Good | 612 | 670 | 133 | |
| 3 | C | 20 | 97 | MA | 90 | 643 | 725 | 195 | Good | 635 | 717 | 174 | |
| 4 | D | 25 | 95 | MA | 95 | 696 | 765 | 184 | Good | 677 | 745 | 152 | |
| 5 | E | 17 | 98 | MA, C | 100 | 665 | 750 | 178 | Good | 653 | 727 | 159 | |
| 6 | F | 16 | 96 | MA, C | 95 | 630 | 711 | 163 | Good | 616 | 695 | 139 | |
| 7 | G | 22 | 97 | MA | 95 | 657 | 741 | 165 | Good | 642 | 715 | 167 | |
| 8 | C | 13 | 95 | MA | 100 | 544 | 615 | 155 | Good | 540 | 600 | 156 | Comparative |
| 9 | C | 10 | 100 | — | 65 | 600 | 685 | 66 | Good | 610 | 694 | 155 | Example |
| 10 | C | 55 | 100 | — | 80 | 470 | 611 | 166 | Good | 514 | 610 | 142 | |
| 11 | C | 40 | 86 | P | 70 | 610 | 634 | 67 | Good | 630 | 682 | 140 | |
| 12 | C | 30 | 88 | MA, C | 90 | 620 | 651 | 85 | Good | 622 | 678 | 135 | |
| 13 | H | 15 | 97 | MA, C | 90 | 545 | 610 | 150 | Good | 540 | 605 | 132 | |
| 14 | I | 15 | 96 | MA | 90 | 600 | 665 | 120 | Good | 544 | 640 | 115 | |
| 15 | J | 20 | 98 | MA | 95 | 640 | 760 | 102 | Good | 635 | 710 | 66 | |
| 16 | K | 22 | 97 | MA | 95 | 655 | 735 | 62 | Poor | 660 | 722 | 45 | |
| 17 | L | 26 | 97 | MA | 100 | 651 | 712 | 121 | Good | 624 | 695 | 137 | |

*F: ferrite, B: bainite, P: pearlite, C: cementite, MA: martensite austenite constituent

INDUSTRIAL APPLICABILITY

According to the present disclosure, it is possible to provide, as a high-strength steel plate of API X80 grade or higher with a thickness of 38 mm or more, a thick steel plate for structural pipes or tubes that exhibits high strength in the rolling direction and excellent Charpy properties at its mid-thickness part without addition of large amounts of alloying elements, and a structural pipe or tube formed from the thick steel plate for structural pipes or tubes. The structural pipe or tube maintains excellent mechanical properties even after subjection to PWHT, and thus is extremely useful as a structural pipe or tube for a conductor casing steel pipe or tube, a riser steel pipe or tube, and so on.

The invention claimed is:

1. A steel plate for structural pipes or tubes, comprising:

a chemical composition that contains, in mass %,

C: 0.030% to 0.100%,
Si: 0.01% to 0.50%,
Mn: 1.50% to 2.50%,
Al: 0.080% or less,
Mo: 0.05% to 0.50%,
Ti: 0.005% to 0.025%,
Nb: 0.005% to 0.080%,
N: 0.001% to 0.010%,
O: 0.0050% or less,
P: 0.010% or less,
S: 0.0010% or less, and a balance consisting of Fe and incidental impurities, with the chemical composition having a carbon equivalent $C_{eq}$ as defined by the following Expression (1) of 0.42 or more:

$$C_{eq}=C+Mn/6+(Cu+Ni)/15+(Cr+Mo+V)/5 \quad (1),$$

where each element symbol indicates content in mass % of the element in the steel plate and has a value of 0 if the element is not contained in the steel plate; and a microstructure at a mid-thickness part of the steel plate that is a dual-phase microstructure of ferrite and bainite with an area fraction of the ferrite being more than 5% and less than 50%, and that contains ferrite grains with a grain size of 15 μm or less in an area fraction of 80% or more with respect to the whole area of the ferrite, wherein the steel plate has a plate thickness of 38 mm or more, and the steel plate satisfies a set of conditions including:

a tensile strength being 620 MPa or more and 825 MPa or less; and a Charpy absorption energy $vE_{-20° C.}$ at −20° C. at the mid-thickness part of 100 J or more.

2. The steel plate for structural pipes or tubes according to claim 1, wherein the chemical composition further contains, in mass %, V: 0.005% to 0.100%.

3. The steel plate for structural pipes or tubes according to claim 2, wherein the chemical composition further contains, in mass %, one or more selected from the group consisting of Cu: 0.50% or less,
Ni: 0.50% or less,
Cr: 0.50% or less,
Ca: 0.0005% to 0.0035%,
REM: 0.0005% to 0.0100%, and
B: 0.0020% or less.

4. A method of producing a steel plate for structural pipes or tubes, comprising at least:

heating a steel raw material having the chemical composition as recited in claim 3 to a heating temperature of 1100° C. to 130° C.;

hot-rolling the heated steel raw material, with a cumulative rolling reduction ratio at 800° C. or lower being set to 70% or more, to obtain a hot-rolled steel plate;

accelerated-cooling the hot-rolled steel plate under a set of conditions including a cooling start temperature being no lower than 650° C., a cooling end temperature being lower than 400° C., and an average cooling rate being 5° C/s or higher, and thereby producing the steel plate having a plate thickness of 38 mm or more, the steel plate having a microstructure at a mid-thickness part of the steel plate that is a dual-phase microstructure of ferrite and bainite with an area fraction of the ferrite being less than 50%, and that contains ferrite grains with a grain size of 15 μm or less in an area fraction of 80% or more with respect to the whole area of the ferrite, and the steel plate satisfying a set of conditions including:

a tensile strength being 620 MPa or more and 825 MPa or less; and a Charpy absorption energy $vE_{-20° C.}$ at −20° C. at the mid-thickness part of 100 J or more.

5. The method producing a steel plate for structural pipes or tubes according to claim 4, further comprising, immediately after the accelerated cooling, reheating the steel plate to a temperature range of 400° C. to 550° C. at a heating rate from 0.5° C/s to 10° C/s.

6. A structural pipe or tube formed from the steel plate for structural pipes or tubes as recited in claim 3.

7. A structural pipe or tube obtainable by forming the steel plate for structural pipes or tubes as recited in claim 3 into a tubular shape in its longitudinal direction, and then joining butting faces by welding from inside and outside to form at least one layer on each side along the longitudinal direction.

8. A method of producing a steel plate for structural pipes or tubes, comprising at least:

heating a steel raw material having the chemical composition as recited in claim 2 to a heating temperature of 1100° C. to 1300° C.;

hot-rolling the heated steel raw material, with a cumulative rolling reduction ratio at 800° C. or lower being set to 70% or more, to obtain a hot-rolled steel plate;

accelerated-cooling the hot-rolled steel plate under a set of conditions including a cooling start temperature being no lower than 650° C., a cooling end temperature being lower than 400° C., and an average cooling rate being 5° C/s or higher, and thereby producing the steel plate having a plate thickness of 38 mm or more, the steel plate having a microstructure at a mid-thickness part of the steel plate that is a dual-phase microstructure of ferrite and bainite with an area fraction of the ferrite being less than 50%, and that contains ferrite grains with a grain size of 15 μm or less in an area fraction of 80% or more with respect to the whole area of the fenite, and the steel plate satisfying a set of conditions including:

a tensile strength being 620 MPa or more and 825 MPa or less; and a Charpy absorption energy $vE_{-20° C.}$ at −20° C. at the mid-thickness part of 100 J or more.

9. The method producing a steel plate for structural pipes or tubes according to claim 8, further comprising, immediately after the accelerated cooling, reheating the steel plate to a temperature range of 400° C. to 550° C. at a heating rate from 0.5° C/s to 10° C/s.

10. A structural pipe or tube formed from the steel plate for structural pipes or tubes as recited in claim 2.

11. A structural pipe or tube obtainable by forming the steel plate for structural pipes or tubes as recited in claim 2 into a tubular shape in its longitudinal direction, and then joining butting faces by welding from inside and outside to form at least one layer on each side along the longitudinal direction.

12. The steel plate for structural pipes or tubes according to claim 1, wherein the chemical composition further contains, in mass %, one or more selected from the group consisting of Cu: 0.50% or less,
Ni: 0.50% or less,
Cr: 0.50% or less,
Ca: 0.0005% to 0.0035%,
REM: 0.0005% to 0.0100%, and
B: 0.0020% or less.

13. A method of producing a steel plate for structural pipes or tubes, comprising at least:

heating a steel raw material having the chemical composition as recited in claim 12 to a heating temperature of 1100° C. to 1300° C.;

hot-rolling the heated steel raw material, with a cumulative rolling reduction ratio at 800° C. or lower being set to 70% or more, to obtain a hot-rolled steel plate;

accelerated-cooling the hot-rolled steel plate under a set of conditions including a cooling start temperature being no lower than 650° C., a cooling end temperature being lower than 400° C., and an average cooling rate being 5° C/s or higher, and thereby producing the steel plate having a plate thickness of 38 mm or more, the steel plate having a microstructure at a mid-thickness part of the steel plate that is a dual-phase microstructure of ferrite and bainite with an area fraction of the ferrite being less than 50%, and that contains ferrite grains with a grain size of 15 μm or less in an area fraction of 80% or more with respect to the whole area of the ferrite, and the steel plate satisfying a set of conditions including:

a tensile strength being 620 MPa or more and 825 MPa or less; and a Charpy absorption energy $vE_{-20°\ C.}$ at −20° C. at the mid-thickness part of 100 J or more.

14. The method producing a steel plate for structural pipes or tubes according to claim 13, further comprising, immediately after the accelerated cooling, reheating the steel plate to a temperature range of 400° C. to 550° C. at a heating rate from 0.5° C/s to 10° C/s.

15. A structural pipe or tube formed from the steel plate for structural pipes or tubes as recited in claim 12.

16. A structural pipe or tube obtainable by forming the steel plate for structural pipes or tubes as recited in claim 12 into a tubular shape in its longitudinal direction, and then joining butting faces by welding from inside and outside to form at least one layer on each side along the longitudinal direction.

17. A method of producing a steel plate for structural pipes or tubes, comprising at least:

heating a steel raw material having the chemical composition as recited in claim 1 to a heating temperature of 1100° C. to 1300° C.;

hot-rolling the heated steel raw material, with a cumulative rolling reduction ratio at 800° C. or lower being set to 70% or more, to obtain a hot-rolled steel plate;

accelerated-cooling the hot-rolled steel plate under a set of conditions including a cooling start temperature being no lower than 650° C., a cooling end temperature being lower than 400° C., and an average cooling rate being 5° C./s or higher, and thereby producing the steel plate having a plate thickness of 38 mm or more, the steel plate having a microstructure at a mid-thickness part of the steel plate that is a dual-phase microstructure of ferrite and bainite with an area fraction of the ferrite being less than 50%, and that contains ferrite grains with a grain size of 15 μm or less in an area fraction of 80% or more with respect to the whole area of the fenite, and the steel plate satisfying a set of conditions including:

a tensile strength being 620 MPa or more and 825 MPa or less; and a Charpy absorption energy $vE_{-20°\ C.}$ at −20° C. at the mid-thickness part of 100 J or more.

18. The method producing a steel plate for structural pipes or tubes according to claim 17, further comprising, immediately after the accelerated cooling, reheating the steel plate to a temperature range of 400° C. to 550° C. at a heating rate from 0.5° C/s to 10° C/s.

19. A structural pipe or tube formed from the steel plate for structural pipes or tubes as recited in claim 1.

20. A structural pipe or tube obtainable by forming the steel plate for structural pipes or tubes as recited in claim 1 into a tubular shape in its longitudinal direction, and then joining butting faces by welding from inside and outside to form at least one layer on each side along the longitudinal direction.

21. The steel plate for structural pipes or tubes according to claim 1, wherein the tensile strength is 620 MPa or more and 765 MPa or less.

* * * * *